US005551134A

United States Patent [19]

Fehrer

[11] Patent Number: 5,551,134

[45] Date of Patent: Sep. 3, 1996

[54] APPARATUS WITH CURVED NEEDLE FOR NEEDLING A NONWOVEN WEB

[76] Inventor: Ernst Fehrer, Auf der Gugl 28, A-4020 Linz, Austria

[21] Appl. No.: 303,378

[22] Filed: Sep. 9, 1994

[30] Foreign Application Priority Data

Sep. 24, 1993 [AT] Austria ..... 1930/93
Feb. 18, 1994 [AT] Austria ..... 329/94

[51] Int. Cl.[6] ..... D04H 18/00
[52] U.S. Cl. ..... 28/115
[58] Field of Search ..... 28/107, 111, 112, 28/113, 114, 115

[56] References Cited

U.S. PATENT DOCUMENTS 3,116,534 1/1964 O'Byrne ..... 28/107

FOREIGN PATENT DOCUMENTS 249392 1/1966 Austria .
2000617 7/1971 Germany ..... 28/107

*Primary Examiner*—C. D. Crowder
*Assistant Examiner*—Larry D. Worrell, Jr.
*Attorney, Agent, or Firm*—Collard & Roe, P.C.

[57] ABSTRACT

An apparatus is described which serves to needle a nonwoven web and comprises a slider-crank mechanism, which is coupled to a rocker pivoted on a pivotal axis that is perpendicular to the direction of travel of the web, and at least one needle board, which is secured to the rocker and carries needles, each of which comprises a shank and a working portion. To ensure a satisfactory penetration of the needles, the working portion of each of needle is curved in a plane that is perpendicular to the pivotal axis of the rocker at least approximately along an arc of a circle that is centered adjacent to the pivotal axis of the rocker.

4 Claims, 3 Drawing Sheets

APPARATUS WITH CURVED NEEDLE FOR NEEDLING A NONWOVEN WEB

BACKGROUND OF THE INVENTION

1. Field of the Invention

This invention relates to an apparatus for needling a nonwoven web moving in a predetermined direction of travel, which apparatus comprises a slider-crank mechanism, which is coupled to a rocker pivoted on a pivotal axis that is perpendicular to said predetermined direction of travel, and at least one needle board, which is secured to the rocker and carries needles, each of which comprises a shank and a working portion.

2. Description of the Prior Art

Needle boards can be actuated by slider-crank mechanisms by means of push rods, which are slidably mounted in slide tracks, or by rockers, which carry the needle boards and to which the slider-crank mechanisms are pivoted (Austrian Patent Specification 249,392). The guidance of the needle boards by a rocker affords the advantage that the design may be simplified because it is no longer necessary to provide push rods and associated slide tracks between the connecting rods of the slider-crank mechanisms and the needle beams, which carry the needle boards. But the guidance of the needle boards by a rocker involves a movement of the needles along an arc of a circle so that an additional movement in the direction of travel of the nonwoven web is imparted to the needles. In that case the punctures formed by the needles in the nonwoven web may be enlarged in the direction of travel of the web so that the fibers are undesirably displaced.

SUMMARY OF THE INVENTION

For this reason it is an object of the invention to provide for the needling of a nonwoven web an apparatus which is of the kind described first hereinbefore and is so improved by the use of simple means that the puncture formed by the needles in the nonwoven web will substantially be restricted to the thickness of the working portion of the needles.

The object set forth is accomplished in accordance with the invention in that the working portion of each of said needles is curved in a plane that is perpendicular to the pivotal axis of the rocker at least approximately along an arc of a circle that is centered adjacent to the pivotal axis of the rocker.

If the working portion of a needle is curved along an arc of a circle about the pivotal axis of the rocker, that working portion will extend along the arcuate path along which The needle is penetrating when the needle board is oscillating with a lift that is determined by the oscillation amplitude of the rocker and an enlarging of the puncture in the direction of travel of the nonwoven web will thus be avoided. An exact agreement of the curvature of the needles and the path for the movement of the needles would require that the working portions of all needles have different curvatures because the needles are spaced different distances from the pivotal axis of the rocker. But this is not necessary in practice because the extent of the needle boards in the direction of travel of the nonwoven web is small relative to the lever length of the rocker. For this reason the working portions of all needles of a needle board may have the same curvature. In that case the centers of curvature of the curved working portions of the needles do not lie on the pivotal axis of the rocker but for most needles are disposed merely adjacent to that pivotal axis.

To ensure that the deviation of the uniform curvature of the working portions of the needles from the arcuate path associated with each needle will be relatively small, the radius of curvature of the working portion of each needle may be equal to the mean distance of all needles of the needle board from the pivotal axis of the rocker.

For a closer matching, the curvatures of the working portions of all needles may be graded in steps. In that case the needles of the needle board are arranged in groups, which succeed each other in the direction of travel of the nonwoven web, and the working portions of the needles of each of said groups have the same curvature. The radius of that uniform curvature of the needles of each group is at least approximately equal to the mean distance of all needles of that group from The pivotal axis of the rocker. An increase of the number of needle groups will permit a finer grading of the radius of curvature of the working portions of the needles. But in most cases the grading which is achieved by the provision of three needle groups will be sufficient, provided that said needle groups extend over the same distance in the direction of travel of the nonwoven web.

It has been outlined hereinbefore that the curvature of the working portion of each needle need not exactly match the arcuate path for the penetrating needle. A slight deviation may even assist the entraining of fibers by the working portion of the needle and may thus assist the formation of a loop because this will result in a component of force that is transverse to the needles and urges the fibers against the needles.

DETAILED DESCRIPTION OF THE PREFERRED EMBODIMENTS

Figure 1:
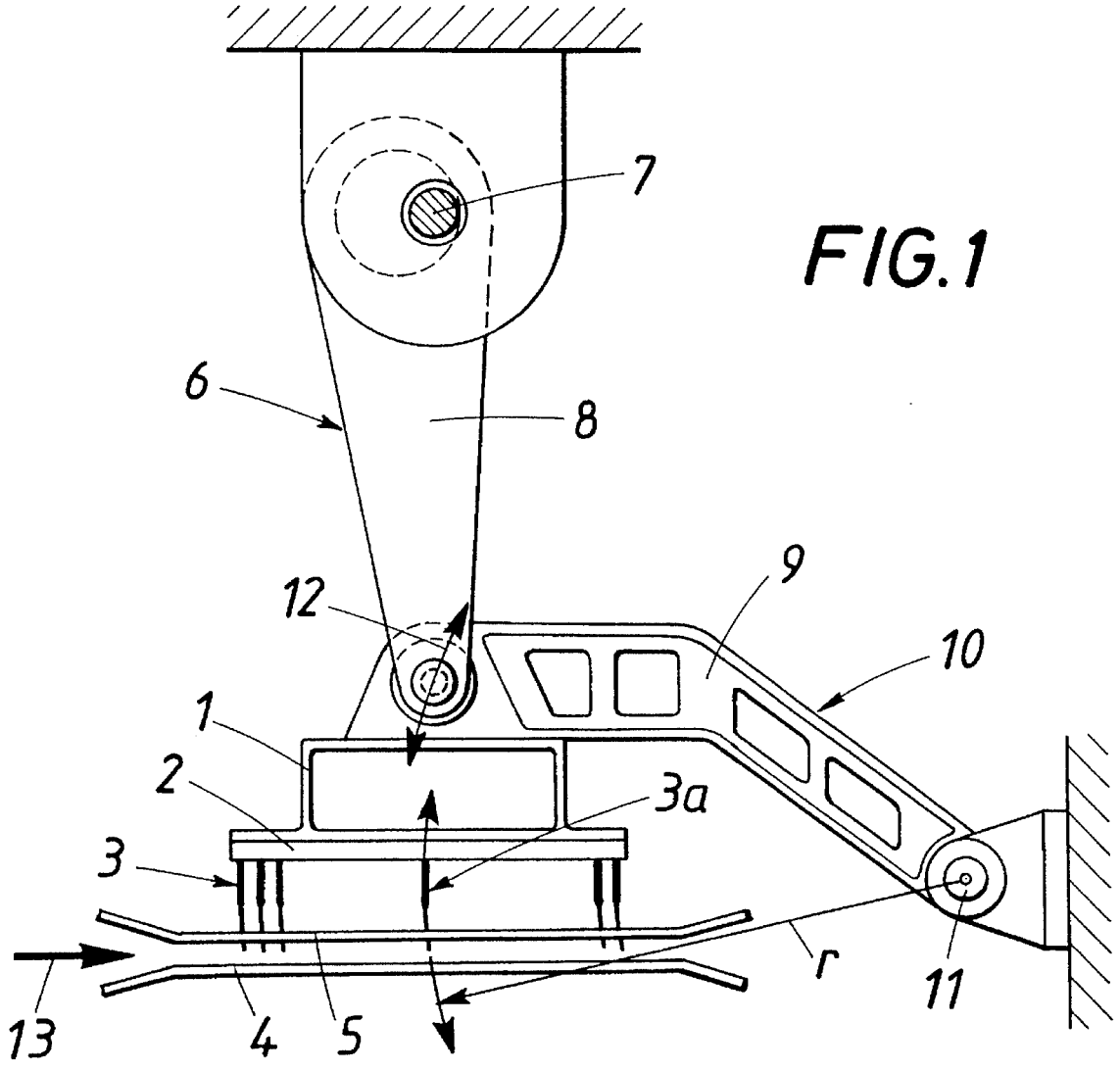
FIG. 1 is a schematic side elevation showing an apparatus in accordance with the invention for needling a nonwoven web.

Illustrative embodiments of the invention will now be described more in detail with reference to the drawing.

The illustrated apparatus comprises in the usual manner at least one needle board 2, which is mounted on a needle beam 1 and comprises a multiplicity of needles 3, which penetrate into a nonwoven web, which is guided in a predetermined direction of travel 13 between a web support 4 and a stripper 5. To permit the needles to move through the web support 4 and the stripper 5, the parts 4 and 5 consist of perforated plates. The needle board is actuated by a slider-crank mechanism 6, which in the usual manner consists of a crankshaft or eccentric shaft 7 and at least two parallel connecting rods 8, which are pivoted to said crankshaft or eccentric shaft 7. The connecting rods 8 are pivoted to parallel arms 9 of a rocker 10, which is pivoted on a pivotal axis 11, which is perpendicular to the direction of travel 13 of the nonwoven web. Because the needle beam 1 is secured to the rocker 10, the needle board is actuated by the slider-crank mechanism 6 by means of the rocker 10 to move up and down about the pivotal axis 11 along an arc of a circle in the directions indicated by the arrows 12. If two or more needle boards are provided, which succeed each other in a direction which is transverse to the direction of travel 13 of the nonwoven web, each needle board will similarly be guided by means of a rocker and actuated by the slider-crank mechanism 6.

Figure 3:
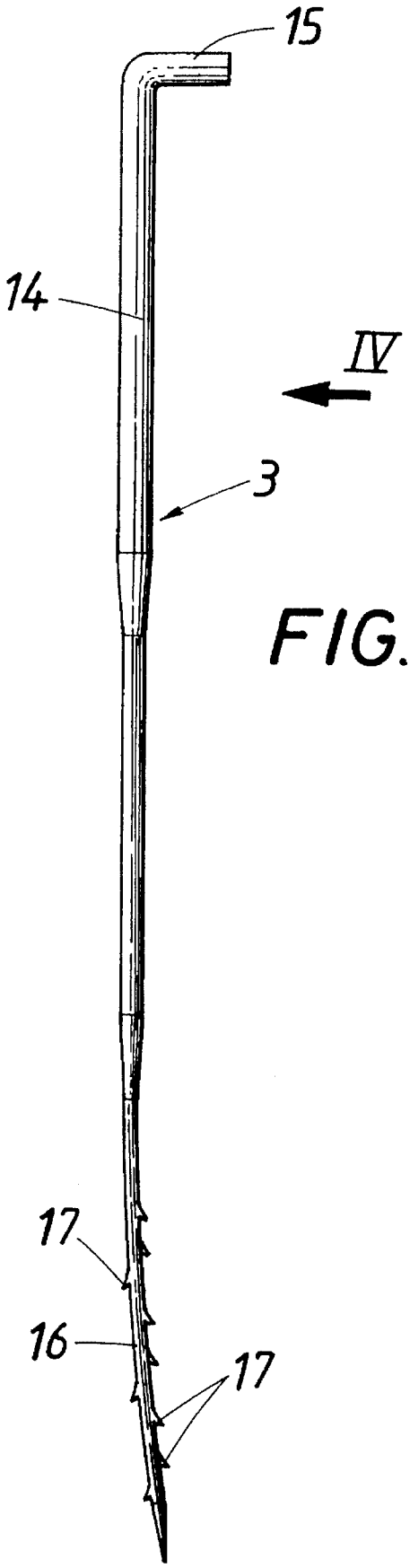
FIG. 3 is a side elevation showing on a larger scale a needle for such an apparatus.
Figure 4:
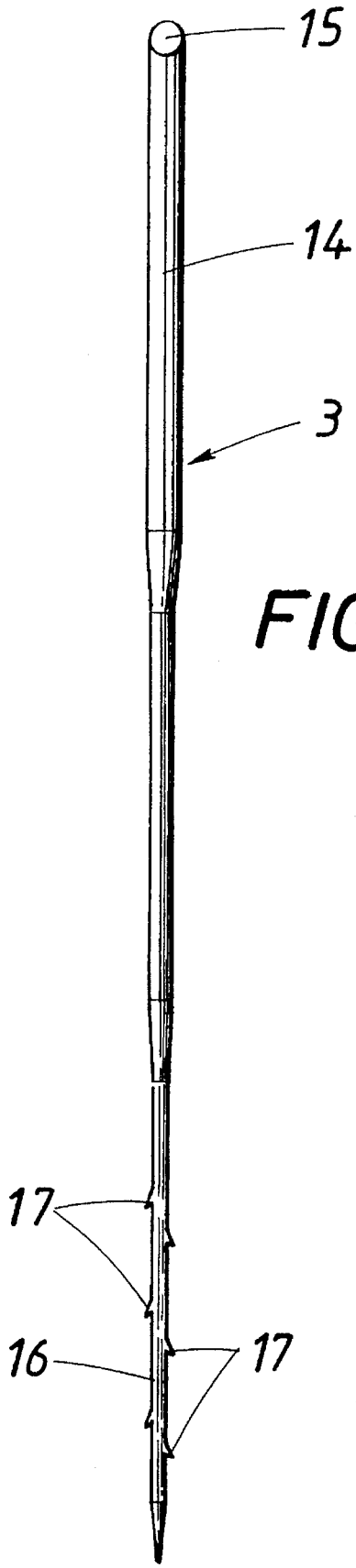
FIG. 4 shows that needle as viewed in the direction of the arrow IV in FIG. 3.

As is illustrated in FIGS. 3 and 4 each of the needles 3 inserted in the needle board 2 comprises a shank 14, which terminates in an angled foot 15, and a working free end portion 16, which is generally triangular in cross-section and at its edges is formed with barbs 17 that are formed by indentations. A difference from conventional straight needles resides in that the working portion 16 of each of said needles is curved in a plane which is perpendicular to the pivotal axis 11 of the rocker 10. The working portion 16 of each needle is curved along an arc of a circle which is centered at least approximately adjacent to the pivotal axis 11. In the embodiment illustrated in FIG. 1 the radius of curvature of the working portion 16 of each needle 3 of the intermediate row 3*a* of needles equals the radial distance r of the needles of that row 3*a* from the pivotal axis 11 so that the working portions 16 of the needles of that row 3*a* of needles have a curvature which exactly matches the path along which the needles of said row 3*a* are moved. On the other hand, the working portion of each of the needles 3 which are more remote from the pivotal axis 11 has a radius of curvature which is slightly too large and the working portion of each of the needles 3 which are closer to the pivotal axis has a radius of curvature which is slightly too small. But as said deviations are small, they are often not significant in practice so that even if such needles are mounted on needle boards guided by rockers they will penetrate the nonwoven web in a manner that is similar to the penetration achieved with needle boards provide which are guided along a straight line.

Figure 2:
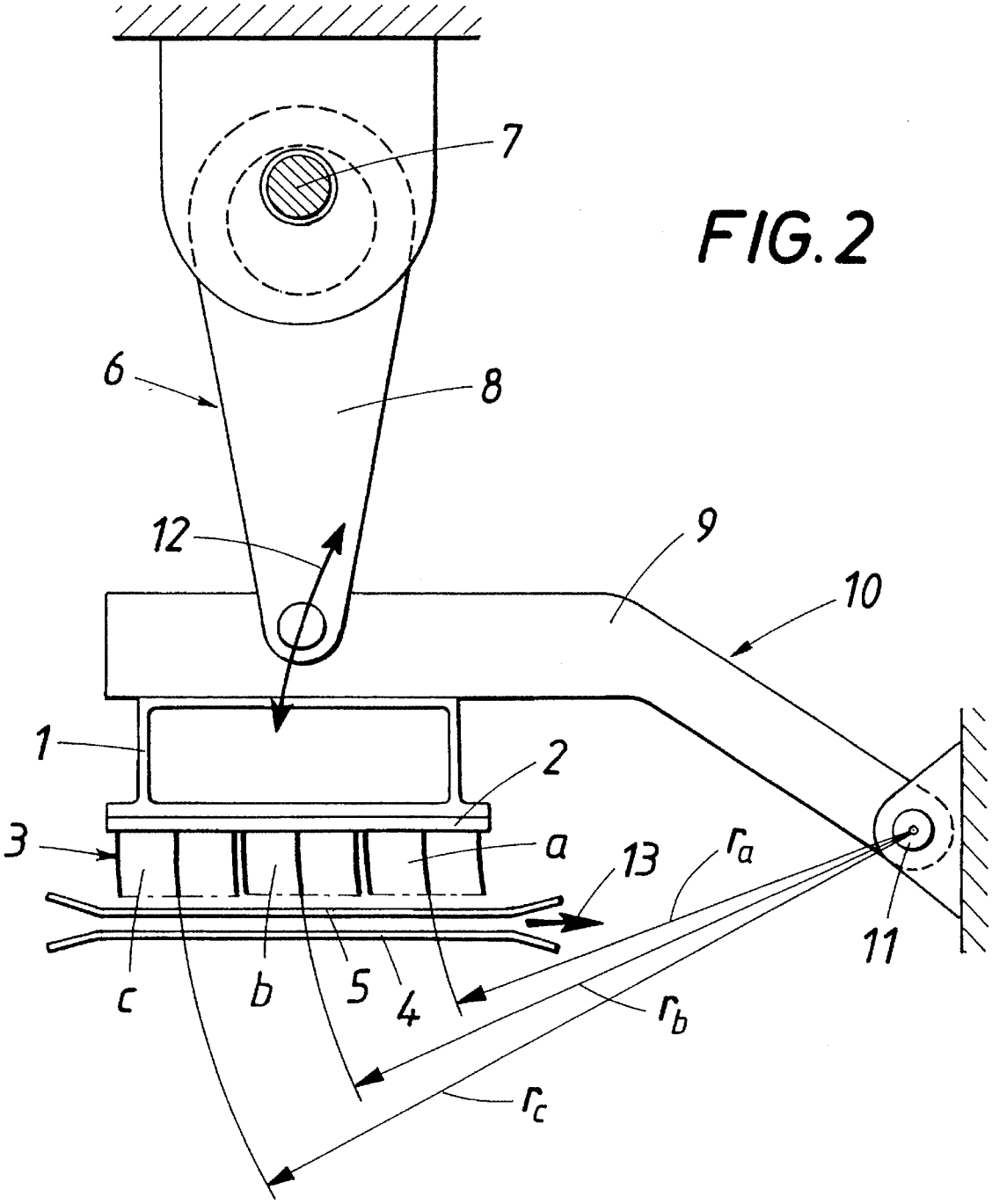
FIG. 2 is a view that is similar to FIG. 1 and shows another embodiment of an apparatus in accordance with the invention.

In the embodiment shown in FIG. 2 the needles 3 of the needle board 2 are arranged in three groups a, b, and c, which succeed each other in the direction of travel 13 of the nonwoven web. The needles 3 of each of said groups are identical but as regards the curvature of their working portions 16 differ from the needles of the other groups. As a result, the curvatures of the working portions 16 of the needles 3 are matched in steps to the paths along which the needles penetrate the nonwoven web. The radius $r_a$ of the curvature of the working portion 16 of each of the needles 3 of that group a which is nearest to the pivotal axis 11 equals the mean distance of all needles of the group a from the pivotal axis 11. This is also applicable to the radii of curvature $r_b$ and $r_c$ of the needles of the needle groups b and c so that the working portions 16 of the needles of the groups b and c have larger radii of curvature matching the paths along which said needles penetrate the nonwoven web.

I claim:

1. In an apparatus for needling a nonwoven web moving in a predetermined direction of travel, which apparatus comprises a rocker, a pivot axis extending perpendicularly to said direction of travel, the rocker being pivoted on said pivot axis, at least one needle board secured to said rocker and carrying a multiplicity of needles, each of which comprises a shank and a free working end portion, and a slider-crank mechanism coupled to said rocker and operable to actuate said needle board by means of said rocker, the improvement residing in that the working end portion of each of said needles is curved in a plane that is perpendicular to said pivot axis at least approximately along an arc of a circle having a center adjacent to said pivot axis.

2. The improvement set forth in claim 1, wherein the arc has a radius of curvature which equals the mean distance of all needles of said needle board from said pivot axis.

3. The improvement set forth in claim 1, wherein said needles of said needle board are arranged in a plurality of groups succeeding, each other in said direction of travel and said working end portion of the needles of each of said groups is curved at least approximately along an arc of a circle having a radius which equals the mean distance of all needles of said group from said pivot axis.

4. The improvement set forth in claim 3, wherein said needles of said needle board comprise at least three groups of needles having working end portions having different radii of curvature.

* * * * *